United States Patent [19]

Wyant

[11] Patent Number: 4,934,584

[45] Date of Patent: Jun. 19, 1990

[54] PORTFOLIO WITH MIRRORIZED COVER

[75] Inventor: Jon R. Wyant, Spring Valley, Ohio

[73] Assignee: The Mead Corporation, Dayton, Ohio

[21] Appl. No.: 357,917

[22] Filed: May 30, 1989

[51] Int. Cl.[5] ..... B65D 27/08

[52] U.S. Cl. ..... 229/1.5 R; 132/316; 190/901; 206/581; 229/72; 281/35

[58] Field of Search ..... 229/1.5 R, 72; 132/301, 132/304, 316; 190/900, 901; 206/581, 235; 281/35

[56] References Cited

U.S. PATENT DOCUMENTS

| | | | |
|---|---|---|---|
| 1,804,487 | 5/1931 | Yoshioka . | |
| 1,809,517 | 6/1931 | Katrinak | 206/581 |
| 2,042,584 | 6/1936 | Bustamante | 132/316 |
| 2,104,361 | 1/1938 | Bryant | 132/304 |
| 2,487,883 | 11/1949 | Le Baron | 132/316 |
| 2,568,941 | 9/1951 | Benson | 229/72 |
| 3,516,599 | 6/1970 | Buttery | 229/72 |
| 4,018,237 | 4/1977 | Steiman | 132/304 |
| 4,743,047 | 5/1988 | Baer | 281/15.1 |

FOREIGN PATENT DOCUMENTS

| | | | |
|---|---|---|---|
| 710695 | 11/1951 | United Kingdom | 132/316 |

*Primary Examiner*—Stephen P. Garbe

*Attorney, Agent, or Firm*—Biebel, French & Nauman

[57] ABSTRACT

A portfolio comprising a front cover having a cut-out section, a rear cover hingedly connected to the front cover, and a flexible sheet having a reflective surface, the sheet being attached to the front cover such that the reflective surface is displayed outwardly through the cut-out section to define a mirror.

2 Claims, 3 Drawing Sheets

38
10
14
12

PORTFOLIO WITH MIRRORIZED COVER

BACKGROUND OF THE INVENTION

The present invention relates generally to portfolios, binders and the like, and more particularly, to such a device having a cover with a mirrorized surface portion.

There has always been a desire among students to monitor their personal appearance during the school day. One way to monitor personal appearance is by occasional observation in a mirror. However, carrying a hand mirror may prove undesirable and inconvenient, particularly when the student is required to carry books, notebooks, and the like. In addition, hand mirrors tend to break easily and can become a danger to the unaware or young student.

SUMMARY OF THE INVENTION

The present invention provides a portfolio having a reflective surface on its front cover. The portfolio preferably is produced from a blank comprising a front cover panel having at least one cut-out section, a rear cover panel, an inner pocket panel, and a flexible reflective sheet secured to the inner surface of the front panel and cooperating with the cut-out section to define a mirror. The blank is folded along fold lines to form a front cover, a rear cover, and inner pockets.

The primary object of this invention, therefore, is to provide a portfolio with pockets for securing paper, notes and the like with a cover having a reflective surface for use as a mirror.

Other objects and advantages of the invention will be apparent from the following description, the accompanying drawings and the appended claims.

DETAILED DESCRIPTION OF THE PREFERRED EMBODIMENT

Figure 1:
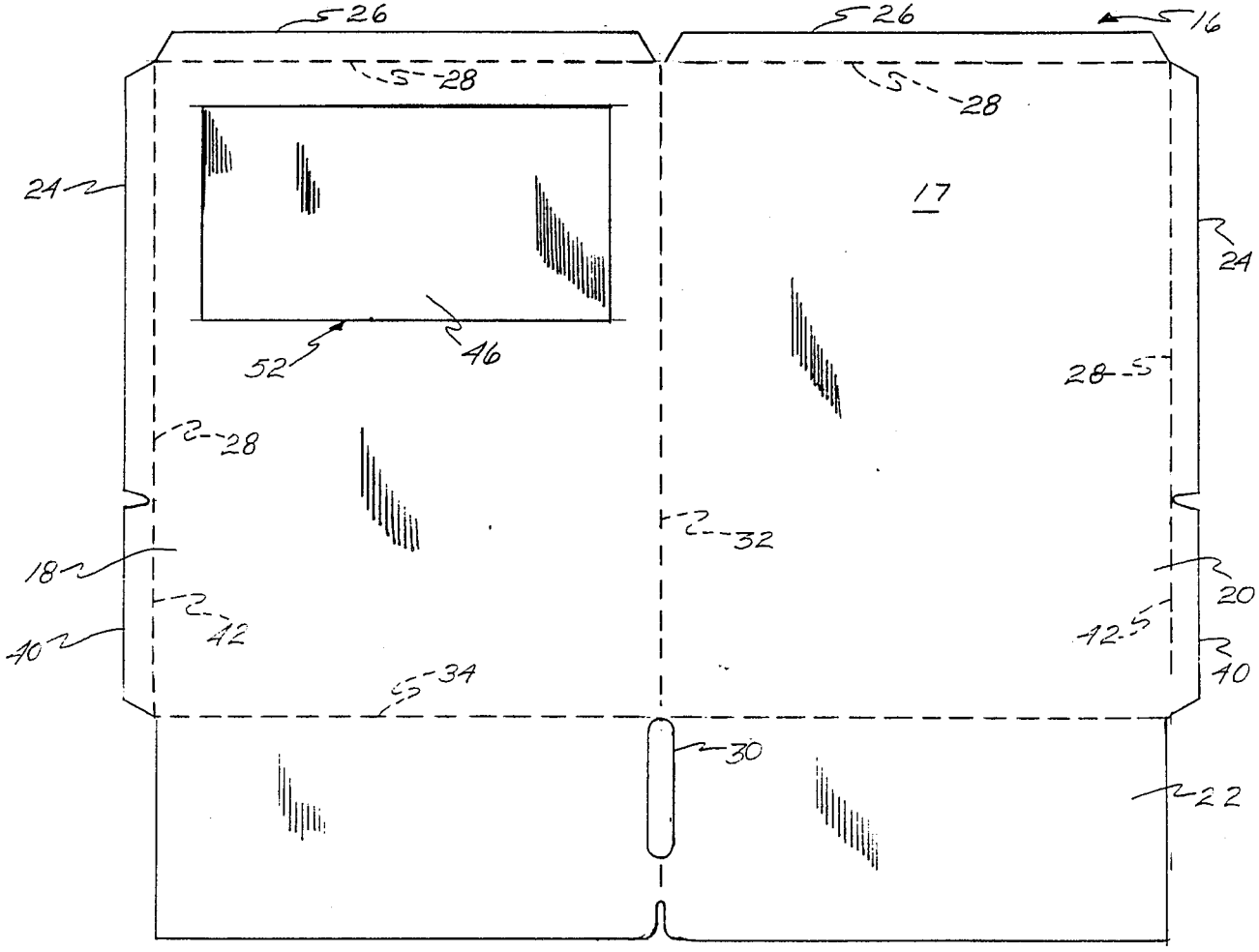
FIG. 1 is a front plan view showing the blank of which the portfolio having a mirrorized cover is formed.
Figure 2:
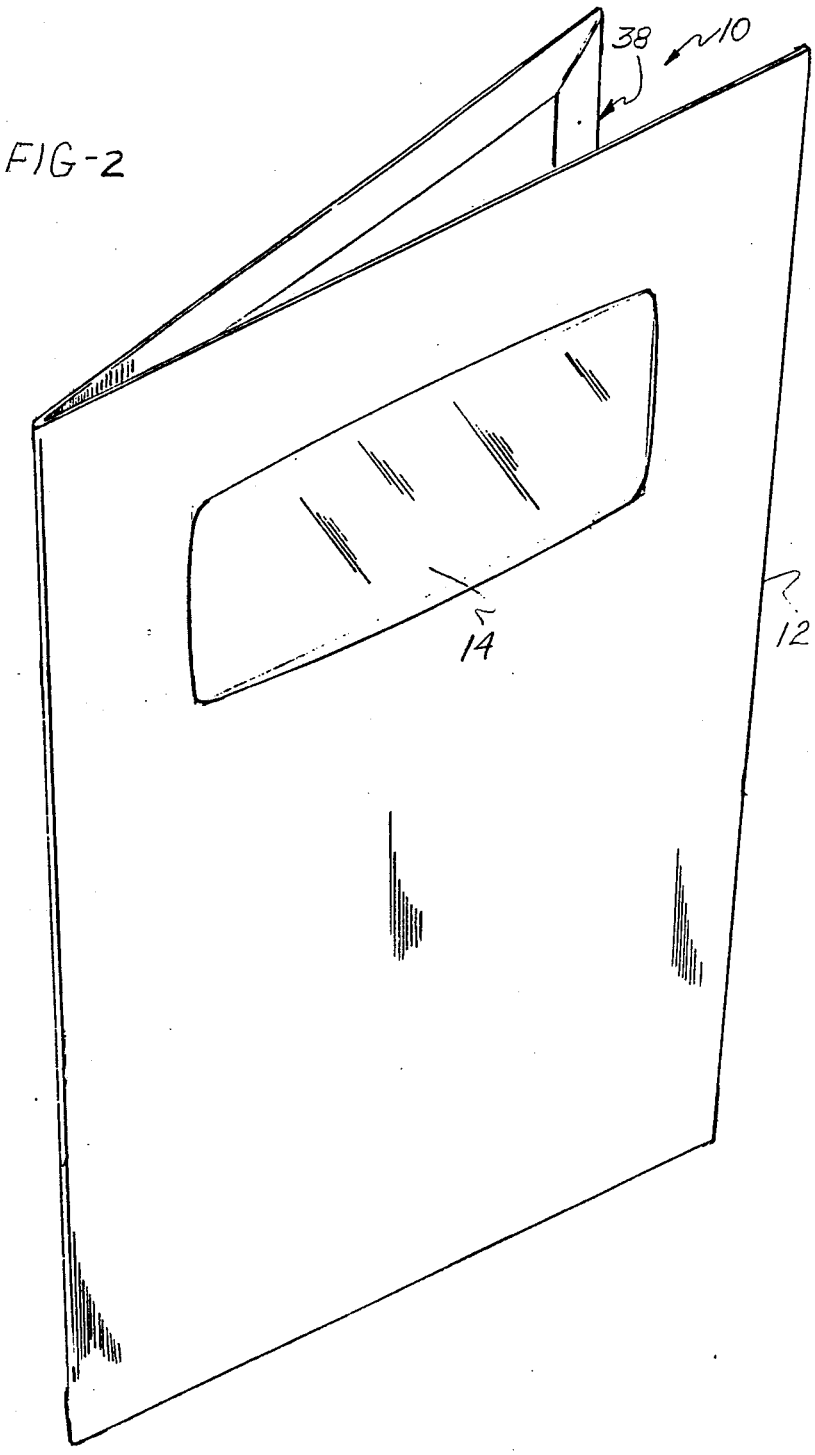
FIG. 2 is a front perspective view of the portfolio having a mirrorized cover constructed in accordance with the present invention.
Figure 3:
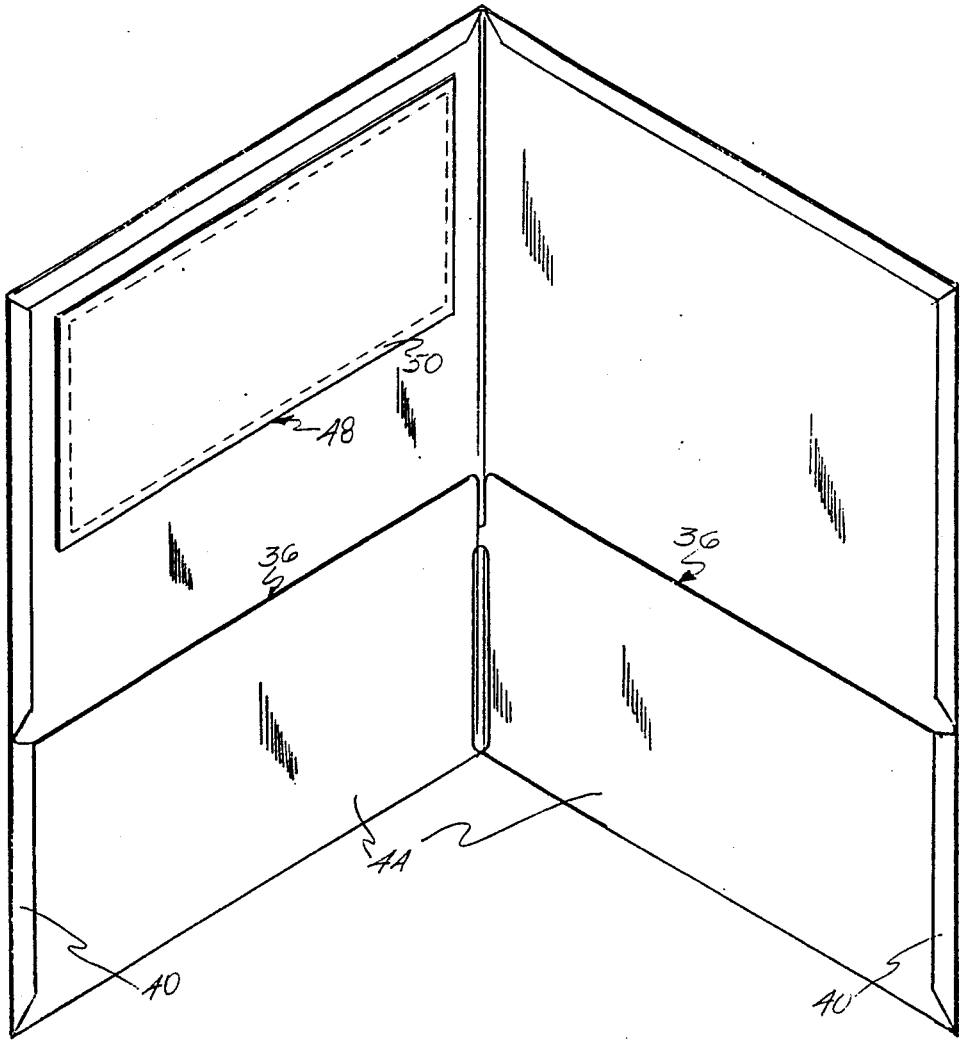
FIG. 3 is a perspective view of the portfolio showing the inner pocket and the inner front cover surface.

Referring to the drawings in greater detail, a portfolio, generally designated 10, having front cover 12 with a reflective surface 14 for use as a mirror is shown in FIGS. 1 through 3. The terms "portfolio" and "binder" may be used interchangeably herein with the understanding that "binder" refers generically to hinged folders whether or not binder rings are provided.

The portfolio 10, as shown in FIG. 1 is formed from a relatively flexible generally rectangular in shape blank 16, which may be manufactured from paperboard, or the like, having a printed graphic design and an acrylic coating on its surface 17, and comprises a front cover panel 18, a rear cover panel 20, and a relatively shorter inner pocket panel 22. The blank 16 further includes relatively narrow marginal side flaps 24 located at each side of blank 16, and relatively narrow marginal top flaps 26 located at the top of the blank 16. The flaps 24 and 26 are adapted to fold over the blank 16 along fold lines 28 to add support and to remove sharp outside surfaces on the front and rear covers.

As shown in FIGS. 1, 2 and 3, the short inner pocket panel 22 includes an elongated slot 30 longitudinally positioned along a fold line 32 to permit the easy opening and closing of the portfolio 10. The inner pocket panel 22 is folded over the front cover panel 18 and the rear cover panel 20 along a fold line 34 to form a pair of inner pockets 36 for securing paper sheets, note pads of the like (not shown). The front cover panel 18 and the rear cover panel 20 are folded along a fold line 32 to form the front cover 12 and a rear cover 38.

The front cover 12 and the rear cover 38 are provided with narrow marginal flaps 40 which are folded along fold lines 42 and adhesively secured to the outer surface 44 of pockets 36 to add strength to front and rear covers 12 and 38 and to hold the inner pocket forming portion 22 in folded position.

The front cover 12 has a generally rectangular cut-out section 46. A generally flexible rectangular sheet 48, manufactured from paperboard or the like, having a reflective surface layer 14 made from metallized polyester, and being slightly larger than the cut-out section 46, is adhesively secured at its edges 50 to the inner surface margins 52 of the front cover 12 surrounding the cut-out section 46 such that the reflective surface 14 is displayed outwardly through the cut-out section 46 to define a mirror. Surface layer 14 preferably comprises a molecular aluminum dust applied to the surface of a high clarity, graphic arts quality polyester sheet by a vacuum deposition process using a heated roller and a cold roller which effectively arc weld the aluminum dust to the polyester sheet.

It should be apparent that the front and rear covers 12 and 38 can easily be varied by providing a variety of graphics on their outer surfaces.

While the form of the product herein described constitutes a preferred embodiment of this invention, it is to be understood that the invention is not limited to this precise form of product, and that changes may be made therein without departing from the scope of the invention which is defined in the appended claims.

What is claimed is:

1. A flexible portfolio comprising:

a flexible front cover provided with a cut-out, a flexible rear cover foldably connected to said front cover along a side margin thereof, an inner pocket defined by a pocket panel folded upwardly and inwardly from a lower margin of one of said covers, and a flexible sheet mounted against the inside surface of said front cover over the region of said cut-out; said sheet having a reflective surface which faces outwardly through said cut-out to define a mirror on the outside surface of said front cover.

2. A portfolio according to claim 1 wherein said reflective surface is an aluminized surface.

* * * * *